US006527600B2

(12) United States Patent
Alonso Merino et al.

(10) Patent No.: US 6,527,600 B2
(45) Date of Patent: Mar. 4, 2003

(54) ELECTRICAL CONNECTOR

(75) Inventors: Angel Alonso Merino, Barcelona (ES); Luis Batllo Roses, Barcelona (ES)

(73) Assignee: Tyco Electronics AMP Espana, S.A., Barcelona (ES)

( * ) Notice: Subject to any disclaimer, the term of this patent is extended or adjusted under 35 U.S.C. 154(b) by 0 days.

(21) Appl. No.: 09/891,437

(22) Filed: Jun. 26, 2001

(65) Prior Publication Data

US 2002/0022412 A1 Feb. 21, 2002

(30) Foreign Application Priority Data

Jul. 7, 2000 (GB) ..... 0016790

(51) Int. Cl.[7] ..... H01R 11/22
(52) U.S. Cl. ..... 439/849; 439/842
(58) Field of Search ..... 439/842, 843, 439/845, 849, 850, 851, 852, 858, 861, 862

(56) References Cited

U.S. PATENT DOCUMENTS 4,487,471 A 12/1984 Freshwater et al.
4,679,887 A * 7/1987 Jackson ..... 439/849
4,713,026 A * 12/1987 Mobley et al. ..... 439/845
5,433,629 A * 7/1995 Yagi et al. ..... 439/843

FOREIGN PATENT DOCUMENTS

EP 0 043 655 B1 11/1983
GB 2 315 929 A 11/1998

* cited by examiner

*Primary Examiner*—P. Austin Bradley
*Assistant Examiner*—Phuongchi Nguyen

(57) ABSTRACT

An improved electrical contact according to the invention has a U-shaped base having a bottom and two opposing side walls that define a tab-receiving channel. The base has an open forward end for receiving a mating tab terminal and a rearward end with a middle region therebetween. A contact spring is disposed over the bottom and has a bridge which spans the bottom between the opposing side walls in the middle region of the base. A first contact arm extends from the bridge towards the forward end and converges towards the bottom to a first contact point and then diverges to a free end thereby defining a mating tab insertion mouth. A second contact arm extends from the bridge towards the rearward end and converges towards the base to a second contact point that is disposed closer to the base than the first contact point. The bridge is continuous with one of the opposing side walls and includes a free end that is attached to the other opposing side wall.

9 Claims, 4 Drawing Sheets

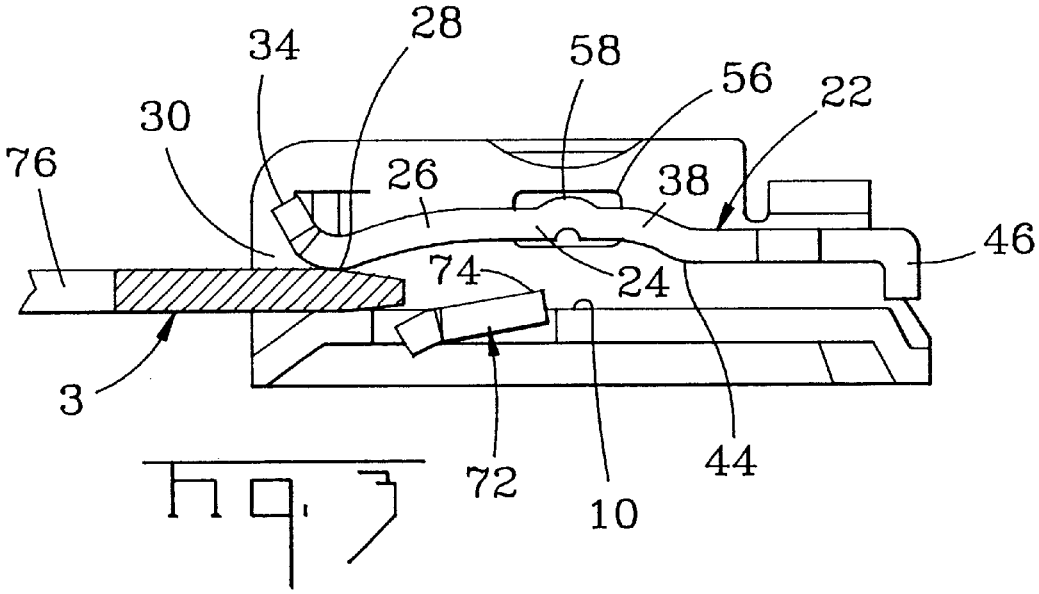
Fig. 3
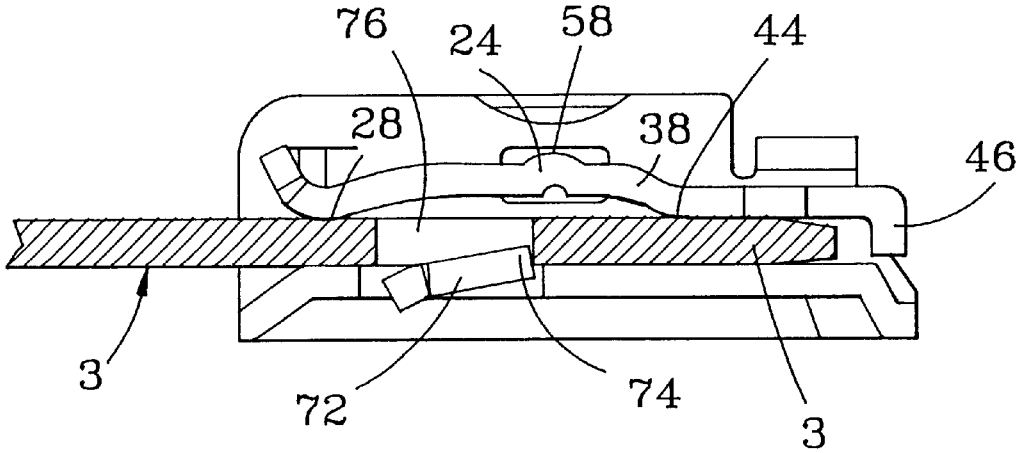
Fig. 4
Fig. 5
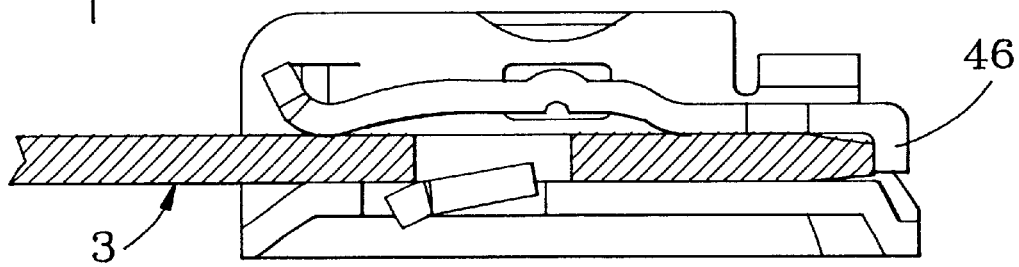

ELECTRICAL CONNECTOR

FIELD OF THE INVENTION

The present invention relates to an electrical contact and in particular to an electrical contact for receiving a complementary tab terminal.

BACKGROUND

It is well known to form an electrical connection between a tab terminal and a complementary electrical contact. One particular style of an electrical contact includes a base that has a bottom surface with two upstanding and opposing side walls from which contact arms are rolled over to form longitudinally extending contact surfaces above the bottom. When the tab is inserted into this type of electrical contact, it is positioned between the bottom and the contact surfaces. An example of a contact of this type is presented in EP 0 043 655. While it is advantageous that a contact of this type can be produced from a single piece of metal, the related contact forces during mating are occasionally undesirably high.

In order to improve upon contacts of this type, it is also known to form a contact having a pivoting contact spring mounted over a base with a bottom surface and two opposing side walls. The pivoting contact spring is typically a separate piece and coupled to the side walls such that a tab-receiving space is formed under the pivoting contact. An example of this type of contact is disclosed in GB 2 315 929. While a contact of this type has reduced insertion forces, manufacturing expenses are high due to the two-part construction.

While it is further known to form an electrical contact having a contact spring member disposed over a base that is formed with the base, as shown in U.S. Pat. No. 4,487,471, there are disadvantages associated with such a design. In particular, the terminal of this reference is only attached to the base along one side. When a mating tab is inserted, the attachment also flexes reducing contact effectiveness.

It would be desirable to improve upon the existing electrical contacts by providing an electrical terminal that avoids the disadvantages associated with the previous designs. It would be further desirable if the electrical contact could be adapted to prevent damage to or overstressing of the contact spring during insertion of the mating tab terminal. It would additionally be advantageous if the contact could be adapted with a locking member such that withdraw forces of the tab terminal are substantially larger than insertion forces. Finally, it would be advantageous if the electrical contact could be manufactured from a single piece of material.

SUMMARY

An improved electrical contact according to the invention has a U-shaped base having a bottom and two opposing side walls that define a tab-receiving channel. The base has an open forward end for receiving a mating tab terminal and a rearward end with a middle region therebetween. A contact spring is disposed over the bottom and has a bridge which spans the bottom between the opposing side walls in the middle region of the base. A first contact arm extends from the bridge towards the forward end and converges towards the bottom to a first contact point and then diverges to a free end thereby defining a mating tab insertion mouth. A second contact arm extends from the bridge towards the rearward end and converges towards the base to a second contact point that is disposed closer to the base than the first contact point. The bridge is continuous with one of the opposing side walls and includes a free end that is attached to the other opposing side wall.

Additionally, tabs located along the side walls toward the forward end can extend out over the bottom such that the mating tab terminal is properly received so as to not damage the contact spring.

Toward the rear end, a further tab may be provided that overlies the contact spring and prevents overstressing of the spring. This tab may also advantageously be used to locate the electrical contact within the housing.

The second contact arm may include a tab terminal locating portion beyond the second contact point to prevent overinsertion of the mating tab terminal.

A locking protrusion may be provided on a spring arm within the bottom of the base, where the locking protrusion extends above the bottom for engaging a complementary feature in the mating tab terminal.

BRIEF DESCRIPTION OF THE DRAWINGS

An embodiment of present invention will be described with reference to the following figures where:

FIG. 3 is a cross-sectional view showing a tab inserted into the contact of FIG. 1;

FIG. 4 is a corresponding cross-sectional view to FIG. 3 showing the tab further inserted;

FIG. 5 is a cross-sectional view of the contact shown in FIG. 3 showing the tab fully inserted.

DETAILED DESCRIPTION OF THE PREFERRED EMBODIMENTS

Figure 1:
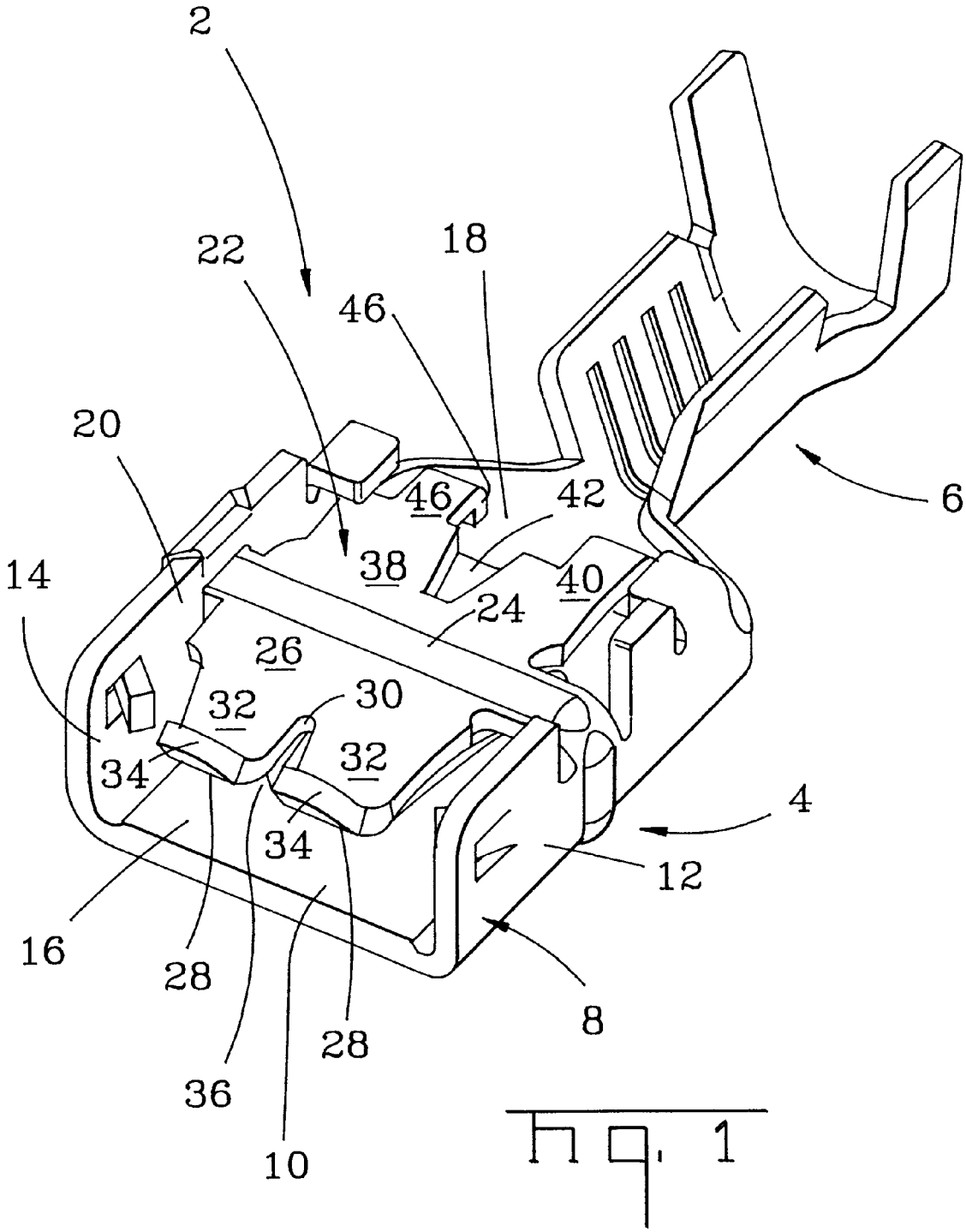
FIG. 1 is an upper perspective view of an electrical contact according to the present invention.

With reference now to FIG. 1, an electrical contact 2 for receiving a mating tab terminal 3 (FIG. 3) includes a receptacle end 4 and a termination end 6. The termination end 6 is configured for crimping to an insulated conductive wire, as is well known. The receptacle end 4 includes a U-shaped base 8 having a bottom 10 and opposing side walls 12,14. The U-shaped base 8 has an open forward end 16, a rearward end 18 and a middle region 20 therebetween.

A contact spring 22 is disposed over the bottom 10. The contact spring 22 includes a bridge 24 that spans the bottom 10 and is coupled to the opposing side walls 12,14. A first contact arm 26 extends towards the forward end 16 and converges towards the bottom 10 to a first contact point 28. In the present embodiment, the first contact arm 26 is bifurcated by slot 30 into two contact arms 32. It is also possible to construct the first contact arm 26 without the slot 30 or with more than one slot 30. The first contact arm 26 then diverges outward to free end 34 defining a mating tab receiving mouth 36.

A second contact arm 38 extends from the bridge 24 towards the rearward end 18 of the base 8. The second contact arm 38 is also bifurcated into two sub-contact arms 40 by a slot 42. The second contact arm 38 also converges towards the bottom 10 to a second contact point 44 as best shown in FIG. 3. The second contact arm 38 further includes a downwardly folded stop tab 46 that further extends towards the bottom 10 such that the mating tab 3 can not be overinserted as best seen in FIG. 5.

Figure 2:
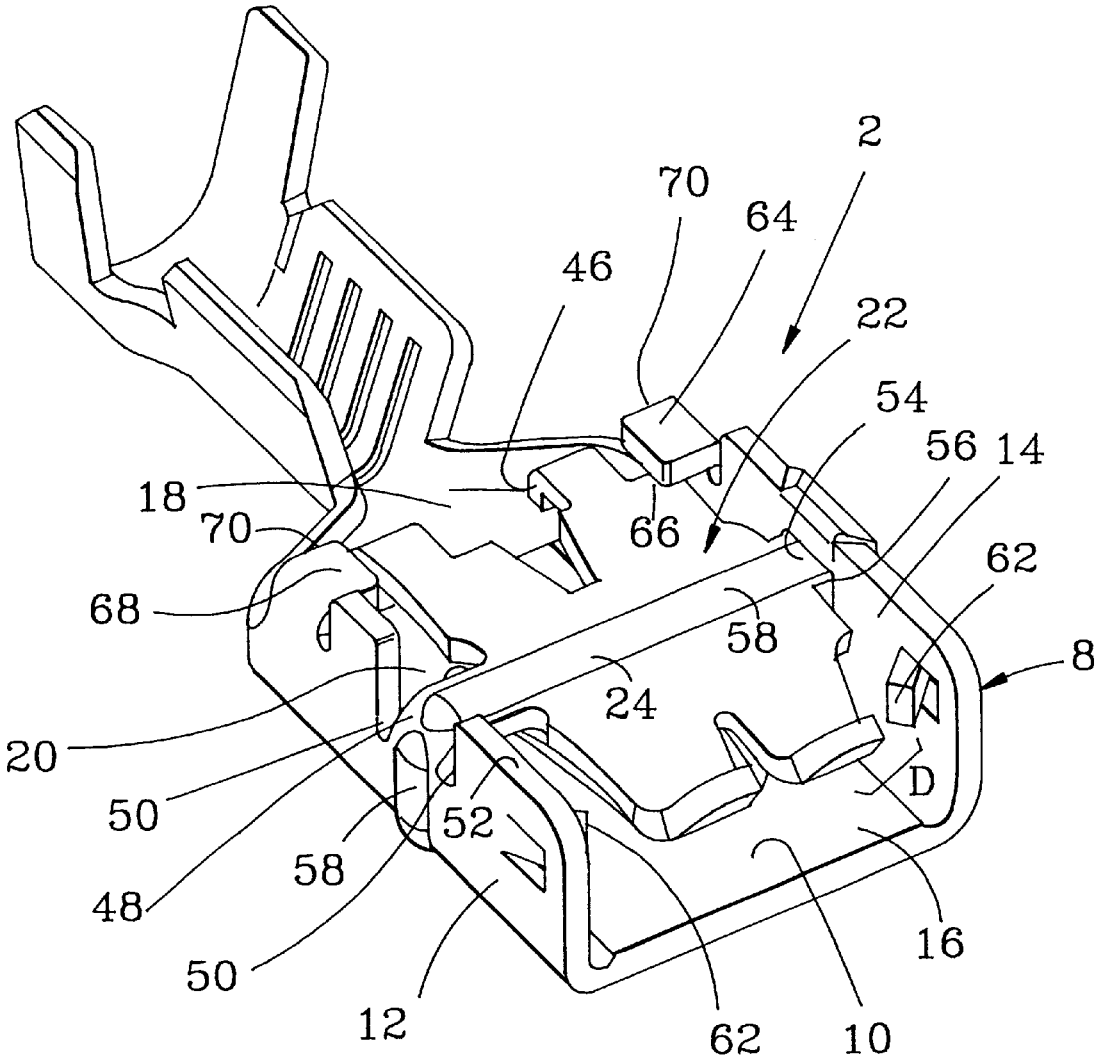
FIG. 2 is mirror image upper perspective view of the electrical contact of FIG. 1.

With reference now to FIG. 2, the incorporation of the contact spring 22 into the contact 2 will be described in greater detail. The bridge 24 is continuously formed with one of the side walls 12 through a transition section 48. The transition section 48 may be defined by cutouts 50 on either side thereof that extend into the side wall 12. These cut outs 50 may extend to the bottom 10 or it is also possible to have the transition 48 formed along the top edge 52 of side wall 12 without these cut outs 50 when the side wall 12 is properly configured. The bridge 24 further includes a tab 54 located opposite to the transition section 48 that extends through an aperture 56 in the opposing side wall 14. The clearance between the tab 54 and the aperture 56 is preferably minimised to prevent undue flexing of the contact spring 22. Additionally, the contact spring 22 may be strengthened by incorporating protuberances 58 in the bridge 24 and/or side wall 12. Further, an additional protuberance 60 may be disposed above the aperture 56 to strengthen that region. The protuberances 58, by strengthening the contact spring 22 in the bridge region 24, may be used to enhance the contact forces exerted by the contact spring 22.

Located toward the forward end 16 of the base 8 are a pair of anti-twist tabs 62, these anti-twist tabs 62 are configured so as not to interfere with the contact spring 22 but to extend over the bottom 10 at a height(D) generally corresponding to slightly more than the thickness of the mating tab terminal 3 so that the mating tab terminal 3 is prevented from being inserted into the electrical contact 2 in a twisted orientation that may cause damage to the contact spring 22. Furthermore, an anti-overstress tab 64 is disposed toward the rearward end 18 of the base 8. This anti-overstress tab 64 overlies a protrusion 66 of the contact spring 22. The anti-overstress tab 64 prevents the contact spring 22 from being over-pivoted and potentially reducing its resiliency. An additional tab 68 that is similarly configured to the anti-overstress tab 64 but does not overlie the contact spring 22 is provided in the opposite wall 12 thereof. Both the anti-overstress tab 64 and the additional tab 68 include a corresponding rear edge 70 for retaining the electrical contact 2 within a housing in a conventional manner.

As best shown in FIGS. 3–5, a locking element 72 is formed in the bottom 10 and extends toward contact arm 26. The Locking element 72 has a retention edge 74 at a free end.

With reference now to FIGS. 3–5, insertion of the mating tab 3 will be described. With reference first to FIG. 3, the mating tab 3 is inserted into the contact mouth 36 such that the tab first becomes engaged with the first contact point 28 along the first contact arm 26. As the first contact arm 26 is relatively long as measured between the first contact point 28 and the bridge 24 and the normal rest spacing between the bottom 10 and the first contact point 28 is only slightly less than the thickness of the mating tab 3, the mating tab 3 encounters only minimal insertion force resistance. This insertion force is shown generally in region A of FIG. 6. Upon further insertion of the mating tab 3, the mating tab 3 comes into contact with the locking element 72 and the retention edge 74 engages an opening 76 in the mating tab 3. The locking element 72 is deflected out of the way and resiles into the opening 76 as the mating tab 3 is inserted through the second contact point 44. Upon insertion of the mating tab 3 to the second contact point 44, which is disposed closer to the base 8 than the corresponding distance relative the first contact point 28, the insertion force rises as shown in region B of FIG. 6. Because of the pivoting nature of the contact spring 22 about the bridge 24, the first contact point 28 is further depressed against the mating tab 3. Additionally, the relatively short nature of the contact arm 38 between the bridge 24 and the contact point 44 provides for a stiff and maintainable contact force upon the mating tab 3 that is maintained as a result of the transition section 48 and the inter-engagement of the tab 54 in the aperture 56. With reference now to FIG. 5, the mating tab 3 can be further inserted but not over-inserted because it abuts the stop tab 46.

Figure 6:
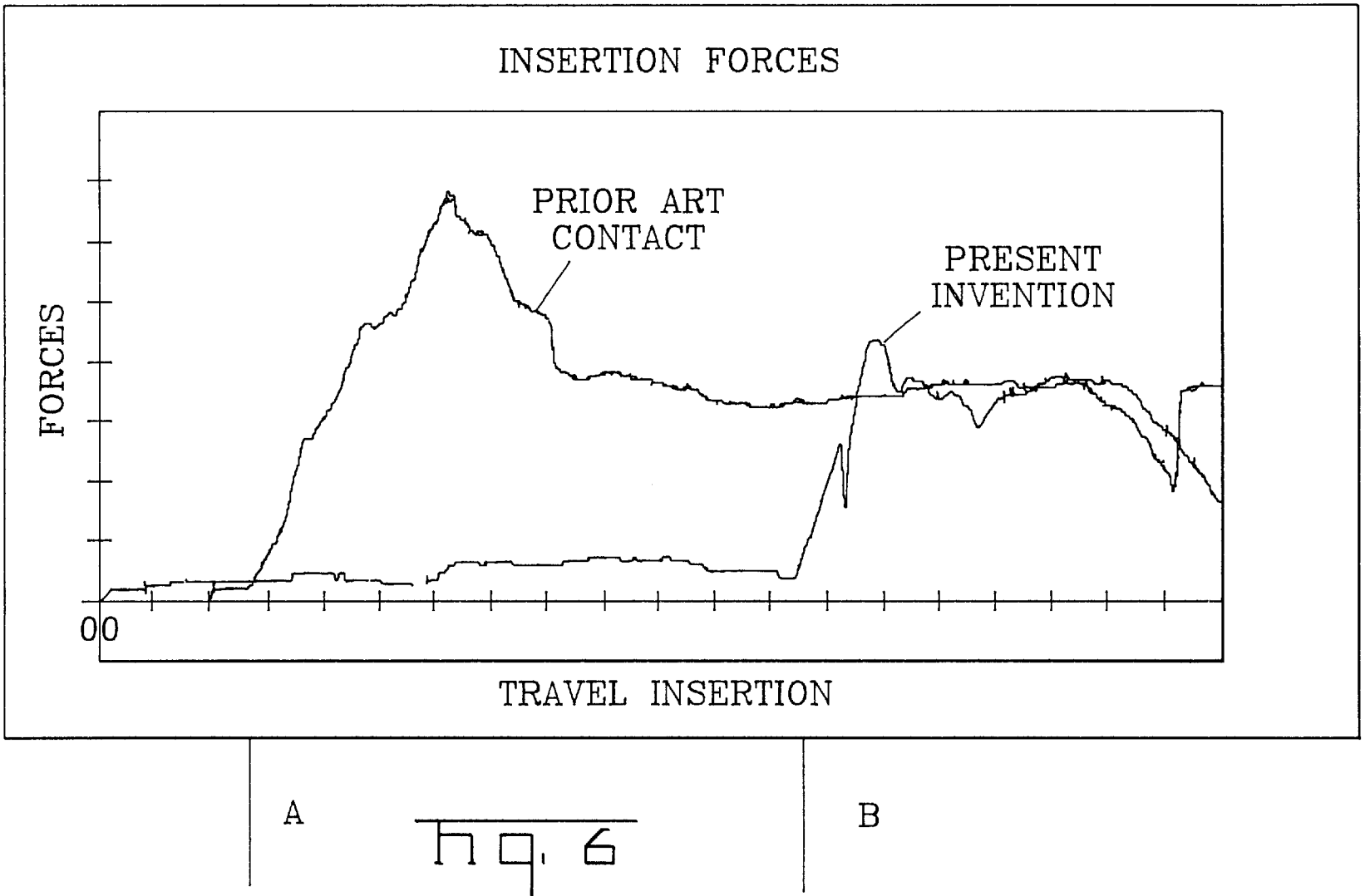
FIG. 6 is a graph of the insertion forces realized during the insertion process of FIGS. 3–5.

With reference now to FIG. 6, a comparison can be made with of the insertion forces of a prior art contact corresponding generally to that set out in EP 0 043 655. As can be seen, the work associated with the insertion of the prior art contact is significantly higher than with a contact according to the present invention. Furthermore, the insertion forces are dramatically lower. The present invention allows all of this to be incorporated within a contact formed of a single piece which can advantageously be produced in conventional stamping and forming operation.

What is claimed is:

1. An electrical contact comprising:

a U-shaped base having a bottom and two opposing side walls therealong that define a tab-receiving channel, the base has an open forward end for receiving a mating tab terminal and a rearward end with a middle region therebetween; and, a contact spring diposed over the bottom that has a bridge spanning the bottom and coupled to the opposing side walls in the middle region of the base where a first contact arm extends from the bridge towards the forward end and converges towards the bottom to a first contact point and then diverges to a free end thereby defining a mating tab insertion mouth and a second contact arm extending from the bridge towards the rearward end and converging towards the base to a second contact point that is disposed closer to the base than the first contact point;

the bridge continously and integrally formed with one of the opposing side walls and the bridge having a free end opposite thereto that is attached to the other opposing side wall.

2. The electrical contact of claim 1, wherein the bridge includes a tab at the free end that extends into an aperture in the other opposing side wall.

3. The electrical contact of claim 1 wherein the sidewalls include locating tabs extending over the bottom at the forward end to assure proper orientation of the mating tab.

4. The electrical contact of claim 1 wherein one of the opposing side walls includes an overstress tab extending therefrom and over the contact spring.

5. The electrical contact of claim 1 wherein a locking arm is formed in the bottom.

6. The electrical contact of claim 1, wherein the bridge is continuous with the one of the opposing side walls through a transition.

7. The electrical contact of claim 6, wherein the transition is defined by a pair of slots on either side thereof that extend into the one of the opposing side walls.

8. The electrical contact of claim 7, wherein the bridge includes a protuberance to enhance the strength thereof.

9. The electrical of claim 8 wherein at least one of the opposing side walls includes a protuberance to enhance the strength thereof.

* * * * *